United States Patent [19]

Okazaki

[11] 4,356,711

[45] Nov. 2, 1982

[54] DEHYDRATOR

[75] Inventor: Shizuo Okazaki, Aichi, Japan

[73] Assignee: Tokyo Shibaura Denki Kabushiki Kaisha, Kawasaki, Japan

[21] Appl. No.: 190,889

[22] Filed: Sep. 25, 1980

[30] Foreign Application Priority Data

| | | | |
|---|---|---|---|
| Sep. 29, 1979 | [JP] | Japan | 54-126683 |
| Nov. 12, 1979 | [JP] | Japan | 54-146801 |
| Nov. 14, 1979 | [JP] | Japan | 54-158283[U] |
| Feb. 28, 1980 | [JP] | Japan | 55-25165[U] |

[51] Int. Cl.[3] ..... D06F 29/02

[52] U.S. Cl. ..... 68/23.5; 68/26; 68/148

[58] Field of Search ..... 68/23.5, 26, 148, 150, 68/181 R, 205 R, 207, 198; 210/405, 510

[56] References Cited

U.S. PATENT DOCUMENTS

| | | | |
|---|---|---|---|
| 1,682,473 | 8/1928 | Bercaw | 68/148 |
| 1,826,816 | 10/1931 | Ogonowski | 68/148 |
| 2,336,086 | 12/1943 | Goldman | 68/198 X |
| 2,615,321 | 10/1952 | Maloy | 68/148 |
| 3,106,725 | 10/1963 | Stiner et al. | 68/198 X |

FOREIGN PATENT DOCUMENTS

| | | | |
|---|---|---|---|
| 1121019 | 1/1962 | Fed. Rep. of Germany | 68/148 |
| 1153339 | 8/1963 | Fed. Rep. of Germany | 68/148 |
| 49-23422 | 6/1974 | Japan . | |
| 853559 | 11/1960 | United Kingdom | 68/148 |
| 859211 | 1/1961 | United Kingdom | 68/148 |

*Primary Examiner*—Philip R. Coe

*Attorney, Agent, or Firm*—Cushman, Darby & Cushman

[57] ABSTRACT

A dehydrator of this invention comprises a rotatable dehydrating tank and a water spray cylinder concentrically disposed therewith and rotated with said dehydrating tank. Said water spray cylinder is formed of a porous material having a large number of water-permeable holes distributed with a density varying with the upper and lower parts of the peripheral wall of said water spray cylinder.

14 Claims, 17 Drawing Figures

DEHYDRATOR

This invention relates to a dehydrator for rinsing and dehydrating washing. Dehydrators for rinsing and dehydrating washing are well known, in which the dehydrating tank and the water spray cylinder are rotated to let water pass through and pick up detergent in the washing and also to let dehydrating occur. However, the conventional dehydrator arranged as described above still has much room for improvement. Specifically, a typical water spray cylinder used with the conventional dehydrator has its peripheral wall provided with a large number of water-discharging holes. The dehydrating tank is intermittently rotated, while water is supplied to the water spray cylinder. The water thus supplied is forcefully ejected on the washing placed around the water spray cylinder by a centrifugal force derived from the rotation of the dehydrating tank and the water spray cylinder, thereby rinsing the washing. Rinsing an dehydrating test with the prior art dehydrator were conducted. During the tests, colored spots were observed in several places on the washing, depending on the kind of water used for rinsing. These spots were caused by water streams being concentratedly ejected on the washing through the holes formed in the water spray cylinder. As a result, water scales, for example, are deposited particularly on those spots at which water streams are concentratedly ejected.

It is accordingly the object of this invention to provide a dehydrator which is free from the abovementioned drawbacks accompanying the conventional dehydrator, and which protects the surface of cleaned washing from the concentrated deposition of a foreign matter such as scales, even if they happen to be contained in rinsing water.

To attain the above described object, a dehydrator of this invention includes a centrifugal dehydrating tank rotatably supported on a housing. A water spray cylinder having a peripheral wall prepared from a porous material and having a large number of fine water-permeable holes is set in place concentrically with the dehydrating tank. The interior of the water spray cylinder defines a water receiving cavity. The dehydrating tank and water spray cylinder are rotated and water is supplied to the water-receiving cavity. Also, apparatus is provided and for drawing off from the housing the water centrifugally ejected from the water-receiving cavity and centrifugally discharged from the dehydrating tank after passing through washing placed around the water spray cylinder. Unlike the prior art dehydrator which ejects water from a plurality of relatively large holes, the dehydrator of this invention has the advantages that the water held in the water-receiving cavity is substantially uniformly sprayed on the washing placed around the peripheral wall of the water spray cylinder from almost all the fine holes of said peripheral wall substantially in an atomized form; and foreign matter such as water scales which happen to be contained in rinsing water is prevented from being concentratedly deposited on the surface of cleaned washing, thereby rendering the resultant color soils, if any, practically unnoticeable.

This invention can be more fully understood from the following detailed description when taken in conjunction with the accompanying drawings, in which.

Figure 1:
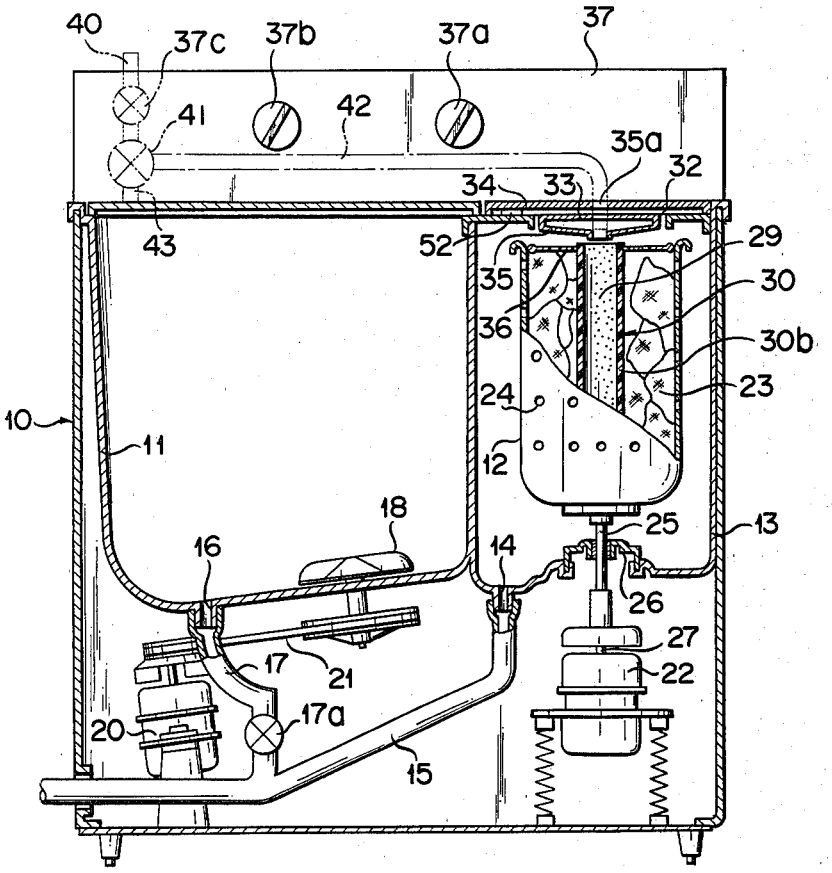
FIG. 1 is a lateral view, partly in section, of a washing machine fitted with a dehydrator embodying this invention.
Figure 2:
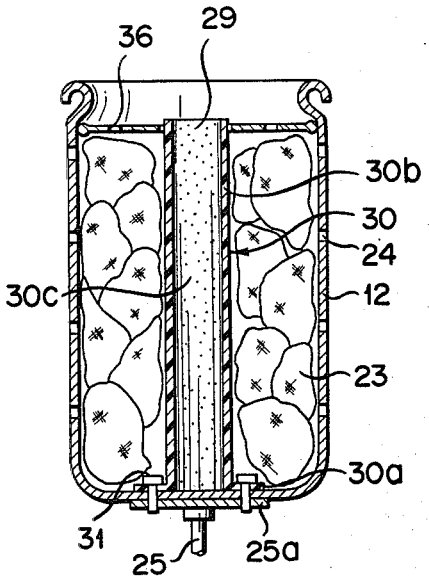
FIG. 2 is a lateral sectional view of a dehydrating tank used with the dehydrator of the invention.
Figure 3:
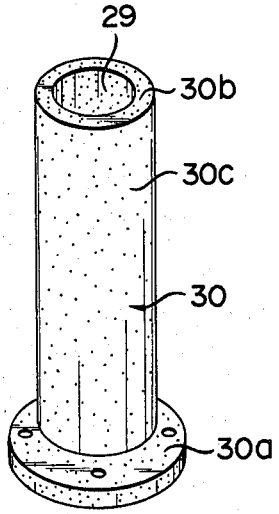
FIG. 3 is an oblique view of a water spray cylinder according to one embodiment of the invention which is fitted to the dehydrating tank of FIG. 2.

Description is now given of a dehydrator according to the preferred embodiments. FIG. 1 is a lateral sectional view of a 2-tank type washing machine fitted with a dehydrator embodying this invention which removes water from washing by a centrifugal force resulting from its rotation. A housing 10 of the dehydrator contains a washing tank 11 and removed water-receiving tank 13 in which a dehydrating tank 12 is rotatably supported. A water-draining port 14 provided at the bottom of the removed water-receiving tank 13 is fitted with a water-draining hose 15. A water-draining port 16 formed at the bottom of the washing tank 11 communicates with the water-draining hose 15 of the removed water-receiving tank 13 through a water-draining hose 17 and valve 17*a*. A pulsator 18 held in the washing tank 11 is rotated by a washing motor 20 set at the bottom of the housing 10 with the aid of a belt mechanism 21. A water-removing motor 22 elastically supported in the lower part of the housing 11 is connected to the bottom of the dehydrating tank 12. As shown in FIG. 2, the peripheral wall of the dehydrating tank 12 is provided with a large number of water-discharging holes 24. The bottom of said dehydrating tank 12 is fitted with a rotatable shaft 25. This rotatable shaft 25 extends downward through bellows 26 (FIG. 1) provided on the underside of the bottom of the removed water-receiving tank 13 and is coupled to the rotary shaft 27 of the water-removing motor 22. A water spray cylinder 30 whose interior defines a water-receiving cavity 29 is set in the dehydrating tank 12 in a concentric relationship therewith. The lower end of the water spray cylinder 30 according to the first embodiment of FIGS. 2 and 3 is fitted with a flange 30*a* (FIG. 2). A shaft rest 25*a* is provided immediately above the upper end of the rotary shaft 25. The dehydrating tank 12 is coupled to the water-removing motor 22 by a screw threadedly fitted into the rotary shaft rest 25*a*, with the bottom of the dehydrating tank 12 clamped between the flange 30*a* and rotary shaft rest 25*a*. The water spray cylinder 30 is formed of porous material having a large number of fine water-permeable holes 30*c* (FIG. 2) (hereinafter referred to as the porous material). With the first embodiment, the diameter of the fine holes 30*c* is chosen to be about 40 microns. The porous material is prepared from porous high molecular polymethyl methacrylate manufactured by Spacy Chemical Company, Inc. under the trademark "Spacy." The peripheral wall 30*b* of the water spray cylinder 30 has a thickness of 30 mm and porosity of 35% with the average hole diameter set at 20 to 70 microns. As will be explained below, during the rinsing and drying processes cylinder 30 is rotated. Obviously cylinder 30 must be sufficiently rigid to withstand the centrifugal forces developed during these processes.

The fine holes 30*c* may be distributed with a uniform density vertically along the peripheral wall 30*b* of the water spray cylinder 30. However, it is preferred that the fine holes 30*c* be distributed with a higher density in the upper part of the peripheral wall 30*b* of the water spray cylinder 30 and with a lower density in the lower part of said peripheral wall 30*b* due to different water pressures in the upper and lower regions of the water spray cylinder 30. This arrangement enables water to be ejected through the fine holes 30*c* of the peripheral wall 30*b* of the water spray cylinder 30 in a substantially fixed volume per unit wall area and per unit time in order to ensure the practically uniform rinsing of clothing. As apparent from FIG. 1, the upper part of the dehydrating tank 13 is fitted with an inner cap 33 and outer cap 34 both used to close and open washing port 32. The underside of the inner cap 33 is fitted with a substantially funnel-shaped water supply member 35. A water-inlet port 35*a* formed in the water supply member 35 is so positioned as to cause water streams to fall from the upper opening of the water spray cylinder 30 to the water-receiving cavity 29. An annular keep plate 36 is detachably fitted between the outer wall of the water spray cylinder 30 and the inner wall of the dehydrating tank 12 to press clothing placed around the water spray cylinder 30. The upper rear part of the housing 10 is fitted with an operation control box 37 which contains a dehydrating timer 37*a*, washing timer 37*b* and electromagnetic water supply valve 37*c*. Running water conducted through a hose 40 and water supply valve 37*c* is selectively supplied to a water supply pipe 42 communicating with the water supply member 35 or a water supply pipe 43 communicating with the washing tank 11 by means of a changeover cock 41.

Figure 4:
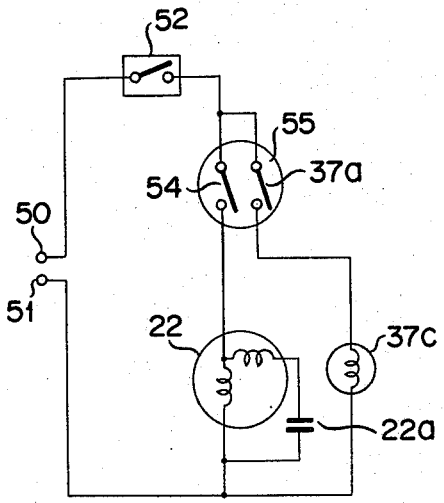
FIG. 4 shows the electric circuit arrangement of the dehydrator of the invention.

FIG. 4 shows an electric circuit arrangement related to the dehydrating-rinsing section of the washing machine of FIG. 1. One input terminal 50 connected to a power source (not shown) is connected to a timer 37*a* having two switches 54, 55 through a switch 52 (FIGS. 1 and 4). The switch 54 is connected to the other input terminal 51 through the water-removing motor 22. The operation of each switch 54, 55 is effected by a cam means (not shown) rotated by a proper drive source, for example, a spring. While the timer 37*a* is set for rinsing, both switches 54, 55 remain closed for a set time. While the timer 37*a* is set for dehydrating, the switch 54 alone is closed for a set time. With the above-mentioned first embodiment, the water-removing motor of FIG. 4 is a single-phase capacitor motor using a capacitor 22*a*.

Description is now given of the operation of the dehydrator shown in FIGS. 1, 2 and 3. The inner cap 33 and outer cap 34 of the removed water-receiving tank 13 are first opened. Washing 23 fully washed in the washing tank 11 is manually placed in the dehydrating tank 12. The inner and outer caps 33, 34 are closed, and the changeover cock 41 is actuated to supply water to the water spray cylinder 30. Where the timer 53 is set for rinsing, then the switches 54, 55 are closed. As a result, the water-removing motor 22 and consequently the dehydrating tank 12 are rotated. At this time, the electromagnetic water supply valve 37*c* is opened to conduct water continuously to the water spray cylinder 30 through said valve 37*c*, changeover cock 41, water supply pipe 42 and water inlet port 35*a*. Accordingly, the water-receiving cavity 29 is filled with water. Since the water spray cylinder 30 and dehydrating tank 12 are jointly rotated, the water held in the water-receiving cavity 29 undergoes pressure corresponding to the water head and also a centrifugal force resulting from the above-mentioned rotation. As a result, the water is forcefully ejected on the washing 23 substantially in the atomized form through a large number of fine water-permeable holes 30*c* formed in the peripheral wall 30*b* of the water spray cylinder 30. The water removed from the washing 23 is carried into the removed water-receiving tank 13 through the water-discharging holes 24 formed in the peripheral wall of the dehydrating tank 12, and finally drawn off to the outside through the water-draining port 14 and water-draining hose 15.

During the above-mentioned rinsing operation, water is sprayed on the washing 23 from the water spray cylinder 30 in the atomized form. Therefore, the water is not ejected concentratedly in particular spots on the washing 23, as is the case with the conventional dehydrator. Therefore, foreign matter, for example, water scales are prevented from being deposited on said particular spots, thereby ensuring uniform rinsing.

A second merit of the dehydrator of this invention is that rinsing is carried out with a far larger amount of water per unit time than in the prior art dehydrator provided with a water spray cylinder having substantially the same size as that of the invention, thereby finishing a rinsing and dehydrating operation in a far shorter time. This merit is now explained with reference to numerical data. Comparison is made between the conventional water spray cylinder having a surface area of 687.2 $cm^2$ and the water spray cylinder of this invention having the same surface area. Now let it be assumed that the widely accepted prior art water spray cylinder is formed of water-impermeable material, and the peripheral wall of said cylinder is provided with 20 water-ejecting holes having a diameter of 0.16 cm. In this case, the total area S1 of water-discharging holes indicates about 0.40 $cm^2$. Further, let it be assumed that the known water spray cylinder having the abovementioned total area S1 of water-discharging holes is replaced by a water spray cylinder embodying this invention which is prepared from a porous material manufactured by Spacy Chemical Company, Inc. provided with a large number of fine water-permeable holes having a diameter of about 40 microns and whose peripheral wall has a porosity of about 50%. Then the total area S2 of water-discharging holes of the present water spray cylinder indicates 343.6 $cm^2$. Therefore, an amount of water carried through said numerous fine water-discharging holes per unit time is about 860 times what is possible with the prior art water spray cylinder. Consequently, the water spray cylinder of this invention which ejects a far larger amount of water than the conventional type and fully sprays water substantially in the atomized form can carry out rinsing with few irregularities. Therefore, the dehydrator of this invention eliminates the necessity, as is the case with the prior art dehydrator, of intermittently operating the dehydrating tank 12 and, during the rest of said dehydrating tank 12, causing water ejected from the water spray cylinder 30 to pass through the whole washing. Thus, the present dehydrator ensures the continuous operation of the dehydrating tank 12 and ceaseless water supply thereto, thereby simplifying the structure of a cam (not shown) for actuating the switches 54, 55 used with the timer 53.

As previously described, fine water-permeable holes are distributed with a higher density in the upper part of the peripheral wall of the water spray cylinder 30 and with a lower density in the lower part of said peripheral wall. This arrangement is derived from the fact that in the lower part of the peripheral wall of the water spray cylinder 30, water is forcefully ejected in fully sufficient amounts through water-discharging holes, though they are distributed with a relatively low density, because the water undergoes a higher pressure corresponding to the greater water depth as well as a pressure resulting from a centrifugal force caused by the rotation of said cylinder 30; and in the upper part of the peripheral wall of the water spray cylinder 30, water can be discharged in substantially the same amount as is realized in the lower part of the peripheral wall of the water spray cylinder 30, because water-discharging holes are distributed with a higher density, though the water pressure is low due to the smaller water depth. If, therefore, said fine water-permeable holes **30*c* are distributed with a proper density along the vertical wall of the water spray cylinder 30 then water can be ejected from the whole peripheral wall of said water spray cylinder 30** at substantially the same rate per unit time, thereby ensuring the uniform rinsing of washing.

Figure 5:
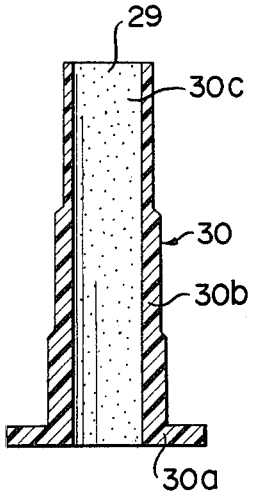
FIG. 5 is a lateral sectional view of a water spray cylinder according to a second embodiment of the invention.

Description is now given of the water spray cylinder 30 of FIG. 5 according to a second embodiment. The peripheral wall **30*b* is formed stepwise with its thickness progressively broadened toward the bottom in order to provide greater resistance toward the bottom to the ejection of water through the water-permeable holes 30*c*. Even if, in the case of the second embodiment of FIG. 5, water-permeable holes 30*c* are uniformly distributed along the vertical plane of the peripheral wall 30*b* of the water spray cylinder 30, water can be ejected through said water-permeable holes 30*c* at substantially the same rate per unit time in the upper and lower parts of said cylinder 30**.

Figure 6:
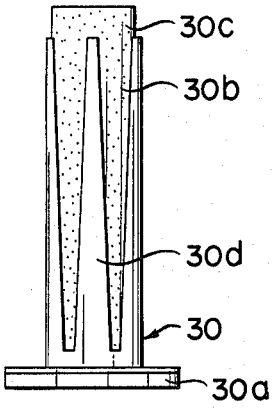
FIG. 6 is a lateral sectional view of a water spray cylinder according to a third embodiment of the invention.

Description is now given of the water spray cylinder 30 of FIG. 6 according to a third embodiment. A plurality of vertically extending substantially triangular cover members **30*d* are mounted on the peripheral wall 30*b* of the water spray cylinder 30, thereby causing a larger number of the fine water-permeable holes 30*c* to be closed toward the bottom, and a smaller number of said holes 30*c* to be closed toward the top. Eventually therefore, washing can be uniformly rinsed regardless of its position in the dehydrating tank 12, due to the aforesaid different levels of water pressure, though a larger amount of water is ejected through the fine water-permeable holes 30*c* toward the top of said water spray cylinder 30, and a smaller amount of water is discharged through the holes 30*c*** toward the bottom thereof.

Various embodiments (FIGS. 7, 8, 9 and 10) of the water spray cylinder 30 enable rinsing water to be ejected through all the water-permeable holes **30*c* of the peripheral wall 30*b* of the water spray cylinder 30, even when a water source, for example, the city water has a low pressure and can not supply sufficient water. Where, with the aforesaid embodiments of a water spray cylinder 30 shown in FIGS. 3, 5 and 6, the cylinder 30 is not fully filled with water due to the low pressure of running water, then water ceases to be ejected through the fine water-permeable holes 30*c* formed in the upper part of said cylinder 30, resulting in the imperfect rinsing of washing placed in the upper part. Such low water pressure usually arises depending on the district of a country, or suddenly occurs due to an accident. Therefore, the embodiments of FIGS. 7, 8, 9 and 10** are very effective to carry out satisfactory rinsing in the above-mentioned circumstances.

Figure 7:
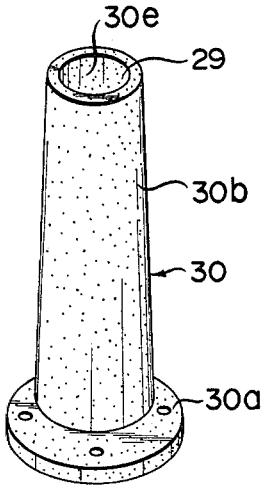
FIG. 7 is an oblique view of a water spray cylinder according to a fourth embodiment of the invention.
Figure 8:
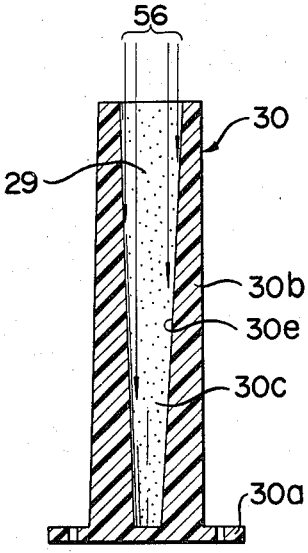
FIG. 8 is a lateral sectional view of the water spray cylinder of FIG. 7.
Figure 9:
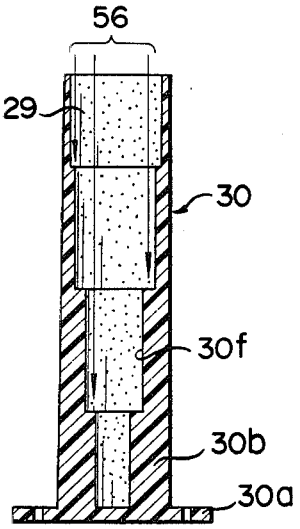
FIG. 9 is a lateral sectional view of a water spray cylinder according to a fifth embodiment of the invention.

FIG. 7 is an oblique view of a water spray cylinder 30 according to a fourth embodiment. FIG. 8 is a longitudinal sectional view of said cylinder 30. This cylinder 30 comprises a flange **30*a* and cylindrical peripheral wall 30*b* erected from the flange 30*a*. The peripheral wall 30*b* is prepared from the previously described porous material. The outer diameter of said peripheral wall 30*b* is progressively enlarged toward the bottom. The inner peripheral wall 30*e* of said cylinder 30 defines an elongated reverse conical space. Water carried from the water supply pipe 42 of FIG. 1 into the cylinder 30 through the water inlet port 35*a* falls with a certain thickness like a water stream 56 shown in FIG. 8. Therefore, most of the falling water runs down the inner peripheral wall 30*e* of the reverse conical space, and is ejected through the fine water-permeable holes 30*c* by the rotation of the cylinder 30 in the atomized form. Since the above-mentioned action of water continues as long as the water falls on the inner peripheral wall 30*e*, the water is ejected through almost all the water-permeable holes 30*c* of the peripheral wall 30*b*. In other words, even where running water is not fully filled in the cylinder 30 due to reduced pressure, the whole washing stacked up to substantially the same height as that of the cylinder 30** undergoes sufficient water spray, thereby ensuring uniform rinsing.

Description is now given of a water spray cylinder 30 according to a fifth embodiment of FIG. 5. With this fifth embodiment, the reverse conical inner peripheral wall **30*e* of FIG. 8 is replaced by an inner peripheral wall 30*f* whose thickness is more narrowed stepwise toward the bottom. In this case, too, falling water runs down the stepped inner peripheral wall 30*f* and is ejected through the fine water-permeable holes 30*c*. Therefore, the stepped inner peripheral wall 30*f* of FIG. 9 takes substantially the same action as the inner peripheral wall 30*e* of FIG. 8**.

Figure 10:
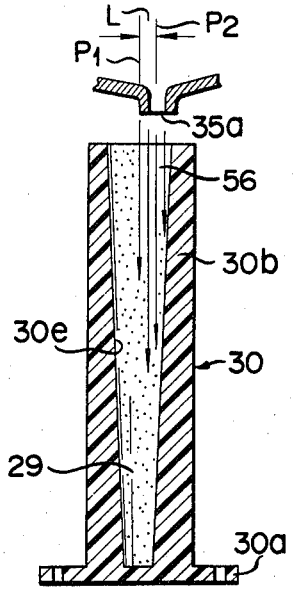
FIG. 10 is a lateral sectional view of a water spray cylinder according to a sixth embodiment of the invention.

Description is now given of a water spray cylinder 30 according to a sixth embodiment of FIG. 10. Even where a water stream falling from the water inlet port 35*a* can not have a sufficient thickness due to, for example, the low pressure of running water, the sixth embodiment of FIG. 10 ensures effective rinsing. With this embodiment, the axis $P_1$ of the upper opening of the cylinder 30 is displaced by a distance L from the axis $P_2$ of the water inlet port 35*a*. If the distance L of said displacement is properly chosen, the whole or greater part of water streams falling from the water inlet port 35*a* can be made to strike against certain portions of the inner peripheral wall 30*e*. Like the embodiments of FIGS. 8 and 9. Therefore, the embodiment of FIG. 10 enables water to be ejected from almost all the fine water-permeable holes 30*c* of the peripheral wall 30*b* of said cylinder 30. The above-mentioned axial displacement can obviously be applied to the water spray cylinder 30 having an inner peripheral wall 30*f* shown in FIG. 9.

Figure 11:
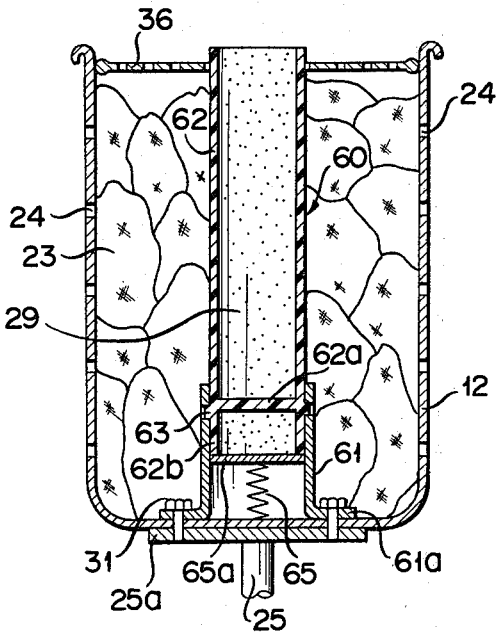
FIG. 11 is a lateral sectional view of a dehydrating tank fitted with a water spray cylinder according to a seventh embodiment of the invention.

Description is now given with reference to FIG. 11. A water spray cylinder 60 according to a seventh embodiment. This cylinder 60 comprises a water spray cylinder body 62 for ejecting rinsing water, coupling cylinder 62*b* formed at the lower end of said cylinder 60 and partition member 62*a* for separating the water spray cylinder body 62 from said coupling cylinder 62*b*. The coupling cylinder 62*b* is inserted into a base portion 61 fitted to the bottom of the dehydrating tank 12 in a substantially concentric relationship with the tank 12. The water spray cylinder 60 extends upward in a concentric relationship with the base portion 61. The bottom of the base portion 61 is provided with a flange 61*a*, and fitted to a rest 25*a* by screws 31 as in FIG. 2 where the water spray cylinder 30 is fitted to the rest 25*a*. The water spray cylinder 60 is formed of the aforementioned porous material. The partition member 62*a* is provided inside of the coupling cylinder 62*b* fitted into the base portion 61. A pair of pins 63 are projectively provided on the outer wall of the coupling cylinder 62*b*.

Figure 12:
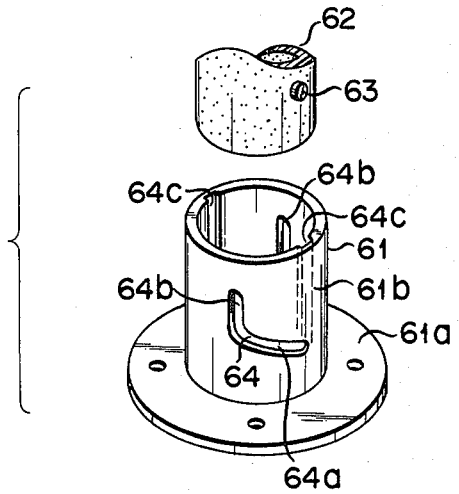
FIG. 12 is an oblique view of the bayonet coupling of the water spray cylinder of FIG. 11 to its base.

FIG. 12 illustrates the bayonet arrangement by which the coupling cylinder 62*b* is detachably fitted into the base portion 61. A pair of L-shaped grooves 64 are formed in the peripheral wall 61*b* of the base portion 61. Each L-shaped groove 64 comprises a horizontal section 64*a* and a vertical section 64*b* extending almost vertically from the bend of the L-shape. A substantially vertical guide groove 64*c* extending from the end of the horizontal section of said L-shaped groove 64 is cut out in the inside of the peripheral wall 61*b*.

Where the water spray cylinder 60 is let to fall while the paired pins 30 are respectively engaged with the guide grooves 64*c* and thereafter is fully rotated clockwise, then said water spray cylinder 60 is automatically lifted to be tightly fitted into the base portion 61. This automatic lifting is effected when a spring 65 stretched between a push board 65*a* and the bottom of the dehydrating tank 12 pushes the coupling cylinder 62*b* by means of said push board 65*a*. The removal of the water spray cylinder 60 from the base portion is carried out by substantially reversing the above-mentioned operation. Therefore, the detailed description of said removal is omitted. The above-mentioned bayonet arrangement enables the water spray cylinder 60 to be easily removed when the dehydrator carries out only the ordinary dehydrating operation, and readily fixed in place when washing is rinsed. Further, the easily detachable fitting of the water spray cylinder 60 is effective for replacement by a new one when said cylinder 60 has its fine water permeable holes considerably plugged with foreign matter, for example, scales and effective for descaling of the plugged holes by taking off the cylinder 60.

The partition member 62*a* acts as a sort of filter for preventing water supplied to the water spray cylinder 60 from being directly drained out without being conducted through the fine pores formed in the peripheral wall of said water spray cylinder 60. In the absence of the partition member 62*a*, water held in the water spray cylinder 60 is drawn off through an opening formed at the lower part of the cylinder 60, passes between the partition member 62*a* and push board 65*a*, and a junction between the base portion 61 and water spray cylinder 60, and thereafter is conducted from the proximity of the upper end of the base portion 61 to the washing placed around said base portion 61. Where, therefore, rinsing water contains such large powder particles of, for example, iron oxide as fail to be carried through the fine pores 30*c*, then the foreign matter soils washing with colors. This coloring event more noticeably arises at the precession of the dehydrating tank 12 which unavoidably occurs when washing is placed in the dehydrating tank 12 in an unbalanced state. The precession of the dehydrating tank 12 causes a clearance between the water spray cylinder 60 and base portion 61 to be broadened or narrowed from time to time. As a result, relatively large particles of foreign matter which happen to be brought into the base portion 61 are more likely to reach the washing through the momentarily changing clearance. The above-mentioned partition members 62*a* is effective to suppress such difficulties. In other words, the partition member 62*a* which acts as a sort of filter prevents large particles of a foreign matter contained in the rinsing water from being deposited on the inside of the coupling cylinder 62*b* or that of the base portion 61. In this case, the partition member 62*a* may obviously be prepared from the ordinary nonporous material, instead of porous material.

Figure 13:
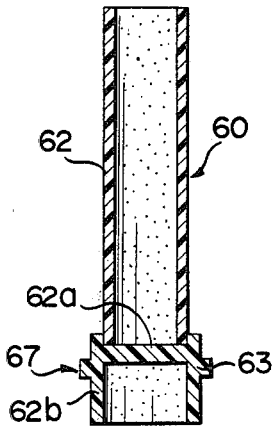
FIG. 13 is a lateral sectional view of a water spray cylinder according to an eighth embodiment of the invention which is fitted to the dehydrating tank of FIG. 11.

Description is now given of a water spray cylinder according to the eighth embodiment of FIG. 13. The water spray cylinder of FIG. 13 is modified from that of FIG. 11. The water spray cylinder of FIG. 13 is wholly formed of the porous material and comprises a water spray cylinder body 62, coupling cylinder 67 and partition member 62*a*. However, the difference between the embodiments of FIGS. 11 and 13 is that with the latter embodiment, the coupling cylinder 67 and partition member 62*a* are integrally formed; the cylinder body 62 is inserted from the top of the coupling cylinder 67 into the partition member 62*a*; and thereafter the water spray cylinder body 62, coupling cylinder 67 and partition member 62*a* are welded together by proper means, for example, the ultrasonic welding process. The partition member 62*a* also acts to ensure the prescribed relative positions of the water spray cylinder body 62 and coupling cylinder 67. With the embodiment of FIG. 13, pins 63 can be formed with high precision in size and position. The reason for this is that the pins 63 which have a small size are integrally formed with the relatively small coupling cylinders 67. The embodiment of FIG. 13 has the advantage of resolving the difficulty presented by the embodiment of FIG. 11 in ensuring the dimensional and positional precision of the pins 63 which are formed on a large water spray cylinder 60.

Figure 14:
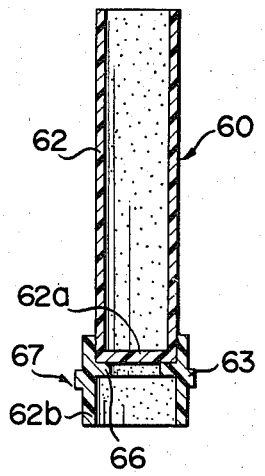
FIG. 14 is a lateral sectional view of a water spray cylinder according to a ninth embodiment of the invention which is fitted to the dehydrating tank of FIG. 11.

Description is now given of a water spray cylinder 60 according to a ninth embodiment of FIG. 14, which resembles that of FIG. 13. Difference between the embodiments of FIGS. 13 and 14 is that with the latter embodiment, the partition member 62*a* is integrally formed with the water spray cylinder body 62 at its lower end; and the coupling cylinder 62*b* is fitted with a flange 66 for ensuring the prescribed position of the water spray cylinder body 62 inserted into said coupling cylinder 62*b* from the top thereof. The embodiment of FIG. 14 has the merits that the same effect as in the embodiment of FIG. 13 is ensured and moreover the coupling cylinder 67 has a greater mechanical strength. Throughout the embodiments of FIGS. 11, 13 and 14, a partition member 62*a* is formed with the water spray cylinder 60. Therefore, water containing relatively large particles of a foreign matter is prevented from being carried into the base portion 61 when supplied to the water spray cylinder body 62.

Figure 15:
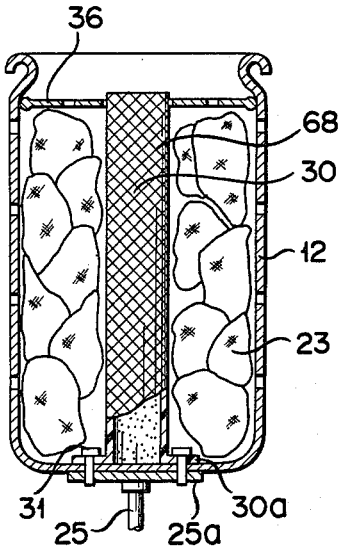
FIG. 15 is a lateral sectional view, partly in section, of a dehydrating tank fitted with a water spray cylinder according to the tenth embodiment of the invention.

Description is now given of the dehydrating tank 12 fitted with a water spray cylinder according to a 10th embodiment of FIG. 15. All the items described below with respect to the 10th embodiment of FIG. 15 are also applicable to the previously mentioned water spray cylinders 30, 60.

Figure 16:
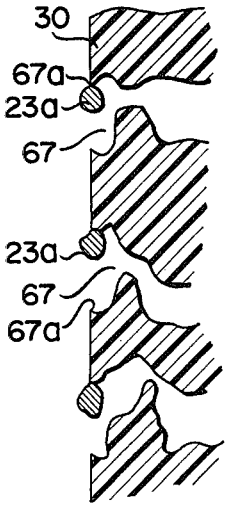
FIGS. 16 and 17 are illustrations showing the effect of a water spray cylinder used with the dehydrating tank of FIG. 15.
Figure 17:
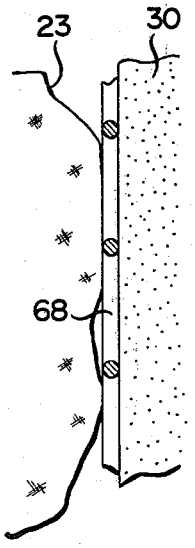

The development of a water spray cylinder of the above-described arrangement is derived from the desire to prevent the occurrence of fibrillation in washing when rinsed by the water spray cylinder 30 prepared from the previously-mentioned porous material. The fibrillation of washed clothing is assumed to arise from the fact that the porous material constituting the water spray cylinder 30 is sintered synthetic resin; the counter edges 67*a* of the numerous fine holes 67 formed in the peripheral wall of the water spray cylinder 30 are still sharp as seen from the enlarged sectional view of FIG. 16, just when the synthetic resin is released from a mold; and the fibers of washing brought into contact with the surface of the water spray cylinder 30 when taken into and out of the dehydrating tank 12 are caught by said outer sharp edges 67*a* of the numerous fine holes 67. With the embodiment of FIG. 15, therefore, the peripheral surface of the water spray cylinder 30 is covered with a protective net 68 to suppress the occurrence of the above-mentioned fibrillation. The protective net 68 has meshes large enough to allow for the easy ejection of rinsing water from the fine holes 67 of the water spray cylinder 30. As apparent from FIG. 17 showing the relative positions of washing 23, protective net 68 and the porous surface of the water spray cylinder 30, the washing 23 is prevented by the protective net 68 from being brought into contact with the surface of the water spray cylinder 30 and consequently saved from fibrillation.

The water spray cylinder 30 is sometimes purposely tinted in order to render a washing machine colorful. In such case, the water spray cylinder 30 is prepared from synthetic resin mixed with a pigment. Above described addition of a pigment to the resin undesirably decreases the mechanical strength of the water spray cylinder 30. With the embodiment of FIG. 15, however, the protective net 68 itself is properly colored, thereby improving the external appearance of a washing machine without reducing the mechanical strength of the water spray cylinder 30. The protective net 68 further has the advantage of preventing the water spray cylinder 30 from being torn in splinters due to a great centrifugal force resulting from its high speed rotation.

What is claimed is:

1. A dehydrator which comprises:

a housing;

a centrifugal dehydrating tank rotatably supported on the housing;

a water spray cylinder having a peripheral wall formed by sintering and prepared from a porous material having a larger number of fine water-permeable holes and set in place concentrically with the dehydrating tank, and whose interior defines a water-receiving cavity;

means for rotating the dehydrating tank and water spray cylinder, said cylinder being sufficiently rigid to withstand centrifugal forces developed by said rotating means;

means for supplying water to the water-receiving cavity; and means for drawing off from the housing the water centrifugally ejected from the water-receiving cavity and centrifugally discharged from the dehydrating tank after passing through washing placed around the water spray cylinder.

2. The dehydrator according to claim 1, wherein fine water-permeable holes formed in the peripheral wall of the water spray cylinder are distributed with a greater density toward the top of said peripheral wall.

3. The dehydrator according to claim 1, wherein the peripheral wall of the water spray cylinder is made thicker toward the bottom and thinner toward the top.

4. The dehydrator according to claim 1, wherein the water spray cylinder is provided with a cover member, which closes a broader area of the peripheral wall of said water spray cylinder toward the bottom and a narrower area of said peripheral wall toward the top.

5. The dehydrator according to claim 1, wherein the inner diameter of the peripheral wall of the water spray cylinder is made continuously larger toward the top.

6. The dehydrator according to claim 5, wherein the water supply means is so positioned as to eject water at a point displaced from the rotation axis of the water spray cylinder.

7. The dehydrator according to claim 1, wherein the inner diameter of the peripheral wall of the water spray cylinder is made stepwise larger toward the top.

8. The dehydrator according to claim 7, wherein the water supply means is so positioned as to eject water at a point displaced from the rotation axis of the water spray cylinder.

9. The dehydrator according to claim 1, which comprises a base portion for fitting the water spray cylinder to the dehydrating tank, and wherein the water spray cylinder comprises a body for ejecting water, a coupling cylinder attached to the body and removably attached to the base portion, and a partition member for separating the water spray cylinder body from the coupling cylinder.

10. The dehydrator according to claim 1, wherein all the components of the water spray cylinder are integrally formed.

11. The dehydrator according to claim 9, wherein the partition member and coupling cylinder are integrally formed, and the water spray cylinder body is inserted into the coupling cylinder, until said cylinder body is securely connected to said partition member.

12. The dehydrator according to claim 9, wherein the water spray cylinder body and partition member are integrally formed of the porous material, and the coupling cylinder is prepared from nonporous synthetic resin.

13. The dehydrator according to claim 9, which comprises a protective net covering the water spray cylinder body.

14. The dehydrator according to claim 1, wherein the water spray cylinder has its peripheral wall covered with a protective net.

* * * * *